US012251013B2

(12) United States Patent
Russell

(10) Patent No.: US 12,251,013 B2
(45) Date of Patent: Mar. 18, 2025

(54) MOUNTING ASSEMBLY

(71) Applicant: Exemplis LLC., Cypress, CA (US)

(72) Inventor: Matthew Russell, Yorba Linda, CA (US)

(73) Assignee: Exemplis LLC, Cypress, CA (US)

( * ) Notice: Subject to any disclaimer, the term of this patent is extended or adjusted under 35 U.S.C. 154(b) by 0 days.

(21) Appl. No.: 18/213,630

(22) Filed: Jun. 23, 2023

(65) Prior Publication Data

US 2023/0413993 A1 Dec. 28, 2023

Related U.S. Application Data

(60) Provisional application No. 63/355,529, filed on Jun. 24, 2022.

(51) Int. Cl.
*A47B 21/04* (2006.01)

(52) U.S. Cl.
CPC ..... *A47B 21/04* (2013.01); *A47B 2200/0084* (2013.01)

(58) Field of Classification Search
CPC . A47B 21/04; A47B 21/06; A47B 2200/0082; A47B 2200/0084; A47B 2021/066; A47F 5/0846; E04B 2002/7483; E04B 2002/7418
See application file for complete search history.

(56) References Cited

U.S. PATENT DOCUMENTS 1,270,718 A 6/1918 Ford
4,074,635 A 2/1978 Stauble
4,198,913 A 4/1980 Haworth
4,296,981 A 10/1981 Hildebrandt et al.
4,372,629 A 2/1983 Propst et al.
4,792,881 A 12/1988 Wilson et al.
5,230,552 A 7/1993 Schipper et al.
5,231,562 A 7/1993 Pierce et al.
5,974,985 A 11/1999 Flototto et al.
6,028,267 A 2/2000 Byrne
6,176,561 B1 * 1/2001 Roels ..... A47B 21/06 108/50.02
6,254,206 B1 7/2001 Petrick et al.
6,283,043 B1 * 9/2001 Stern ..... A47B 21/00 108/50.02

(Continued)

*Primary Examiner* — Patrick D Hawn
(74) *Attorney, Agent, or Firm* — VIA LLP

(57) ABSTRACT

A mounting assembly can comprise a channel member defining a channel and comprising a first side wall, a bottom wall a second sidewall opposite the first wall, an aperture between upper ends of the first and second sidewalls, and a ridge positioned on the bottom wall and extending along a longitudinal axis of the channel member. A first anchor member can comprise a first top wall, a first connector portion, and a first anchor leg extending downwardly from the top wall at a first anchor leg angle. A second anchor member can comprise a second top wall, a second connector portion configured to connect with the first connector portion, and a second anchor leg extending downwardly from the top wall at a second anchor leg angle. The first and second anchor members can be configured to be captured within the channel member when the first connector portion is connected to the second connector portion and the first anchor leg and the second anchor leg are positioned within the channel.

17 Claims, 8 Drawing Sheets

(56) References Cited

U.S. PATENT DOCUMENTS 6,327,983 B1 12/2001 Cronk et al.
6,397,762 B1 6/2002 Goldberg et al.
6,578,498 B1 6/2003 Draudt et al.
6,619,601 B1 9/2003 Vall
6,712,433 B2 * 3/2004 Hellwig ..... A47B 21/00 312/196
6,725,784 B2 * 4/2004 Crinion ..... A47B 87/002 108/50.01
6,732,661 B2 5/2004 Grasse et al.
6,792,876 B2 * 9/2004 Lin ..... A47B 21/0314 108/50.01
6,802,577 B2 10/2004 Gershfeld
7,312,393 B2 12/2007 McCarthy
7,536,960 B1 5/2009 Perez et al.
D596,877 S * 7/2009 Oshinomi ..... D6/691.5
7,966,951 B1 6/2011 Black et al.
8,109,215 B2 * 2/2012 Kitada ..... A47B 21/00 312/196
8,146,514 B2 * 4/2012 Hamilton ..... A47B 13/06 108/50.01
D660,059 S 5/2012 Nilsson
8,295,036 B2 10/2012 Byrne
8,360,373 B2 1/2013 Johnson et al.
8,664,527 B2 3/2014 Ruotsala
8,667,904 B2 3/2014 Pajic
8,689,705 B2 4/2014 Martin et al.
8,925,569 B2 1/2015 Hwang et al.
9,095,209 B2 8/2015 Mirth et al.
9,210,999 B2 12/2015 Martin et al.
9,247,812 B2 * 2/2016 Parshad ..... A47B 83/001
9,468,312 B2 10/2016 Denby
9,516,945 B2 12/2016 Johnson et al.
9,578,961 B1 2/2017 Johnson et al.
9,611,641 B2 * 4/2017 Hamilton ..... A47B 91/00
9,743,758 B2 8/2017 Johnson et al.
9,901,168 B2 2/2018 Menayan et al.
10,028,576 B1 7/2018 Yao
10,117,511 B2 * 11/2018 Gosling ..... A47B 21/04
10,202,992 B2 * 2/2019 Matthai ..... F16B 2/12
10,231,537 B2 3/2019 Miller et al.
10,258,157 B2 * 4/2019 Wayner ..... A47B 96/1441
10,383,435 B1 8/2019 Lundberg et al.
10,463,151 B2 * 11/2019 Murphy ..... A47B 57/34
10,492,601 B2 12/2019 Mirth et al.
10,638,833 B1 5/2020 Brucha
11,457,732 B2 * 10/2022 Colin ..... A47B 87/002
2002/0069797 A1 6/2002 Case
2003/0189393 A1 10/2003 Draudt et al.
2003/0217673 A1 11/2003 Berger et al.
2004/0149177 A1 8/2004 Gayhart et al.
2004/0261668 A1 12/2004 Jarke et al.
2010/0024688 A1 2/2010 Kitada et al.
2010/0236452 A1 9/2010 Ruddy
2012/0160136 A1 6/2012 Lineal et al.
2013/0147716 A1 6/2013 Hawker et al.
2014/0261100 A1 * 9/2014 Henriott ..... F16B 12/40 108/50.02
2015/0292794 A1 10/2015 Bienick
2017/0042323 A1 2/2017 Johnson et al.
2018/0055216 A1 3/2018 Mirth et al.

* cited by examiner

MOUNTING ASSEMBLY

BACKGROUND OF THE INVENTIONS

Field of the Inventions

The present inventions relate to mounting assemblies that can be used for attaching two or more articles together, for example but without limitation, attaching an accessory to a piece of furniture.

Description of the Related Art

Various different designs exist for removably mounting accessories to pieces of furniture. For example, clamps have commonly been used to attach accessories, such as lights or monitor arms, to the top of a table or desk.

SUMMARY OF THE INVENTIONS

An aspect of at least one of the inventions disclosed herein includes the realization that a mounting assembly can be constructed in such a way as to allow for a convenient, optionally toolless, connection procedure and a sufficiently stable connection so as to retain an article in a predetermined position relative to another article. For example, a mounting assembly can include a receiver member which defines an insertion passage oriented at a predetermined passage angle and an anchor member that is configured for insertion into the receiver along the predetermined passage angle, into a position in which the anchor member is stably seated within the receiver. The receiver and anchor member can be configured such that when the anchor member is seated in the receiver member, the anchor member is constrained against twisting and/or removal from the receiver along a direction is not coincident with the predetermined passage angle. As such, the anchor member can be conveniently and easily seated into the receiver member, provide a stable mounting for an accessory, yet resist removal from the receiver member along directions different than the predetermined passage angle.

Another aspect of at least one of the inventions disclosed herein include the realization that a mounting assembly can include a receiver member and at least two anchor members, in which the anchor members are configured for insertion into the receiver member along two different directions that are non-parallel to each other. The anchor members can be configured for engagement with each other in a manner that constrains the movement of the anchor members relative to one another in at least one direction. Thus, the connection portions are not required to provide constraints against movement in all directions in order to achieve a state in which the anchor members are both locked into the channel member. Such a mounting assembly can optionally be employed as a tool-less design.

Thus, in an embodiment, a mounting assembly can comprise a receiver member, which can be in the form of a channel member defining a channel and comprising a first wall, a bottom wall, and a second wall opposite the first wall. An aperture can be positioned between upper ends of the first and second sidewalls. A ridge can be positioned on the bottom wall and extend along a longitudinal direction of the channel member. An anchor member can include a top wall portion and an anchor leg extended downwardly from the top wall at an anchor leg angle. The anchor member and the receiver member can be configured to constrain the anchor member within the channel member when the anchor leg is received within the receiver member.

Optionally, the mounting assembly can include a connector portion configured to provide a further constraint against movement of the anchor member relative to the receiver member. For example, at least one of the anchor member and the receiver can include a connector portion configured to provide an interference fit between the anchor member and the receiver member. In some embodiments, the connector portion is spaced away from the anchor leg. In some embodiments, the receiver member can be configured to define an insertion passage extending along an angled insertion direction along which the anchor leg can be inserted into the receiver member, and wherein the connector portion is configured to constrain movement of the anchor member along a component direction of the angled insertion direction, and thereby interfere with movement of the anchor leg out of the receiver along the angled insertion direction.

In another embodiment, a mounting assembly can comprise a receiver member, which can be in the form of a channel member defining a channel and comprising a first wall, a bottom wall, and a second wall opposite the first wall. An aperture can be positioned between upper ends of the first and second sidewalls. A protrusion can be positioned on the bottom wall and extend along a longitudinal direction of the channel member. A first anchor member can include a top wall portion a first connection portion, and a first anchor leg extended downwardly from the top wall at a first anchor leg angle. A second anchor member can include a top wall, a second connector portion configured to connect with the first connector portion, and a second anchor leg extending downwardly from the top wall at a second anchor leg angle. The first and second anchor members can be configured to be captured within the channel member between the sidewalls and the protrusion when the first connector portion is connected to the second connector portion and the first anchor leg and the second anchor leg are positioned within the channel.

Another aspect of at least one of the inventions disclosed herein includes the realization that a mounting assembly including a channel member and one or more anchor members, can be configured to allow the anchor members to slide longitudinally along the channel member when the anchor members are inserted into the channel member. Such a configuration provides additional convenience to a user for adjusting a position of the anchor and/or any accessory attached to the anchor, along channel member which, in some environments of use, would result in the mounting of an accessory in a different position and adjustably, along a surface of a piece of furniture such as a table or a desk, or other kinds of furniture.

In some aspects, the techniques described herein relate to a desk having an accessory mount for mounting accessories to the desk, the desk including: a first leg assembly; a desktop supported by the leg assembly; a channel member having a longitudinal axis and recessed into the desktop, the channel member having a channel including a first side wall, a bottom wall and a second sidewall opposite the first side wall, the channel member including: an aperture between upper ends of the first and second side walls; a ridge positioned on the bottom wall, extending along a longitudinal axis of the channel member, wherein the ridge protrudes upwardly from the bottom wall, dividing the bottom wall into a first side portion between the ridge and the first sidewall and a second side portion between the ridge and the second sidewall; wherein the first and second sidewalls, the aperture and the ridge form a first insertion passage extending through the aperture toward the first side portion along a first insertion angle and a second insertion passage through the aperture and towards the second side portion along a second insertion angle, the first and second insertion passages being non parallel to each other and non-perpendicular to the bottom wall; a first anchor member including a first top wall and a first anchor leg extending downwardly from the top wall at a first anchor leg angle that is approximately equal to the first insertion angle, and a first connector portion; wherein the first anchor leg is sized so as to be constrained by the aperture, first sidewall, second sidewall, and the ridge, in use, to movement along the first insertion angle when the first anchor leg is inserted into the first side portion of the channel member; a second anchor member including a second top wall and a second anchor leg extending downwardly from the top wall at a second anchor leg angle that is approximately equal to the second insertion angle, and a second connector portion configured to connect with the first connector portion; wherein the second anchor leg is sized so as to be constrained by the aperture, first sidewall, second sidewall, and the ridge, in use, to movement along the second insertion angle when the second anchor leg is inserted into the second side portion of the channel member; wherein when the first connector portion is connected to the second connector portion with the first anchor leg positioned in the first side portion of the channel member and the second anchor leg positioned in the second side portion of the channel member, the connected first and second anchor members are constrained from removal from the channel member along any direction extending from within the channel member outwardly through the aperture.

In some aspects, the techniques described herein relate to a desk additionally including an accessory attached to the first anchor member, the first and second anchor members securing the accessory to the channel member in a position above the desktop.

In some aspects, the techniques described herein relate to a table having an accessory mount, the table including: a first leg assembly; a tabletop supported by the leg assembly; a channel having a longitudinal axis and being recessed into the tabletop, the channel including: a first side wall; a bottom wall; a second sidewall opposite the first wall; an aperture between upper ends of the first and second sidewalls; and a ridge positioned on the bottom wall, extending along the longitudinal axis of the channel; a first anchor member including a first top wall, a first connector portion, and a first anchor leg extending downwardly from the top wall at a first anchor leg angle; a second anchor member including a second top wall, a second connector portion configured to connect with the first connector portion, and a second anchor leg extending downwardly from the top wall at a second anchor leg angle; wherein when the first connector portion is connected to the second connector portion with the first anchor leg positioned in the first side portion of the channel and the second anchor leg positioned in the second side portion of the channel, the connected first and second anchor members are constrained from removal from the tabletop along any direction extending from within the channel outwardly through the aperture.

In some aspects, the techniques described herein relate to a table additionally including an accessory attached to the first anchor member, the first and second anchor members securing the accessory to the channel member in a position above the tabletop.

In some aspects, the techniques described herein relate to a table, wherein the ridge protrudes upwardly from the bottom wall, dividing the bottom wall into the first side portion between the ridge and the first sidewall and the second side portion between the ridge and the second sidewall.

In some aspects, the techniques described herein relate to a table, wherein the first and second sidewalls, the aperture and the ridge form a first insertion passage extending through the aperture toward the first side portion along a first insertion angle and a second insertion passage through the aperture and towards the second side portion along a second insertion angle, the first and second insertion passages being non parallel to each other and non-perpendicular to the bottom wall.

In some aspects, the techniques described herein relate to a table, wherein the first anchor leg angle is approximately equal to the first insertion angle and the second anchor leg angle that is approximately equal to the second insertion angle.

In some aspects, the techniques described herein relate to a table, wherein the first anchor leg is sized so as to be constrained by the aperture, first sidewall, second sidewall, and the ridge, in use, to movement along the first insertion angle when the first anchor leg is inserted into the first side portion of the channel and wherein the second anchor leg is sized so as to be constrained by the aperture, first sidewall, second sidewall, and the ridge, in use, to movement along the second insertion angle when the second anchor leg is inserted into the second side portion of the channel.

In some aspects, the techniques described herein relate to a mounting assembly including: a channel member defining a channel and including a first side wall, a bottom wall a second sidewall opposite the first wall, an aperture between upper ends of the first and second sidewalls, and a ridge positioned on the bottom wall and extending along a longitudinal axis of the channel member; a first anchor member including a first top wall, a first connector portion, and a first anchor leg extending downwardly from the top wall at a first anchor leg angle; a second anchor member including a second top wall, a second connector portion configured to connect with the first connector portion, and a second anchor leg extending downwardly from the top wall at a second anchor leg angle; wherein the first and second anchor members are configured to be captured within the channel member when the first connector portion is connected to the second connector portion and the first anchor leg and the second anchor leg are positioned within the channel.

In some aspects, the techniques described herein relate to a mounting assembly additionally including an accessory attached to the first anchor member, the first and second anchor members securing the accessory to the channel member.

In some aspects, the techniques described herein relate to a mounting assembly, wherein the ridge protrudes upwardly from the bottom wall, dividing the bottom wall into the first side portion between the ridge and the first sidewall and the second side portion between the ridge and the second sidewall.

In some aspects, the techniques described herein relate to a mounting assembly, wherein the first and second sidewalls, the aperture and the ridge form a first insertion passage extending through the aperture toward the first side portion along a first insertion angle and a second insertion passage through the aperture and towards the second side portion along a second insertion angle, the first and second insertion passages being non parallel to each other and non-perpendicular to the bottom wall.

In some aspects, the techniques described herein relate to a mounting assembly, wherein the first anchor leg angle is approximately equal to the first insertion angle and the second anchor leg angle that is approximately equal to the second insertion angle.

In some aspects, the techniques described herein relate to a mounting assembly, wherein the first anchor leg is sized so as to be constrained by the aperture, first sidewall, second sidewall, and the ridge to movement along a first insertion angle when the first anchor leg is inserted into the first side portion of the channel member and wherein the second anchor leg is sized so as to be constrained by the aperture, first sidewall, second sidewall, and the ridge to movement along a second insertion angle when the second anchor leg is inserted into the second side portion of the channel member.

In some aspects, the techniques described herein relate to a mounting assembly, in combination with a desk having a desktop, the channel member being recessed into the desktop.

In some aspects, the techniques described herein relate to a mounting assembly, wherein when the first connector portion is connected to the second connector portion with the first anchor leg positioned in the first side portion of the channel member and the second anchor leg positioned in the second side portion of the channel member, the connected first and second anchor members are constrained from removal from the channel member along any direction extending from within the channel member outwardly through the aperture.

In some aspects, the techniques described herein relate to a mounting assembly, wherein the channel member further includes a second insertion passage oriented at a second angle that is oblique relative to the bottom wall and different than the first angle, the second insertion passage being configured to receive insertion of the anchor leg when moved in a direction along the second angle with the anchor member oriented in a second orientation that is different from the first orientation, in use.

In some aspects, the techniques described herein relate to a mounting assembly, wherein the anchor member additionally includes a snap connector configured to provide a snap fit with the channel member.

In some aspects, the techniques described herein relate to a mounting assembly, wherein the anchor member additionally includes a connector portion configured to engage with a body adjacent to the anchor member so as to prevent the anchor member from moving along the first direction. mounting assembly

DETAILED DESCRIPTION OF THE PREFERRED EMBODIMENTS

An improved mounting assembly is disclosed herein. The mounting assembly is described in the context of a mounting assembly for attaching an article to a piece of furniture, such as a table or a desk, because the mounting assemblies disclosed herein have particular utilities in that context. However, the embodiments disclosed herein can be used in other contexts as well, for example, but without limitation, any environment for connecting articles to one another, lighting systems, racks, or other contexts.

In the following detailed description, terms of orientation such as "top," "bottom," "front," "upper," "lower," "longitudinal," "horizontal," "vertical," "lateral," "midpoint," and "end" may be used here to simplify the description in the context of the illustrated embodiments. Because other orientations are possible, however, the present inventions should not be limited to the illustrated orientations. Those skilled in the art will appreciate that other orientations of various components described herein are possible.

Figure 1:
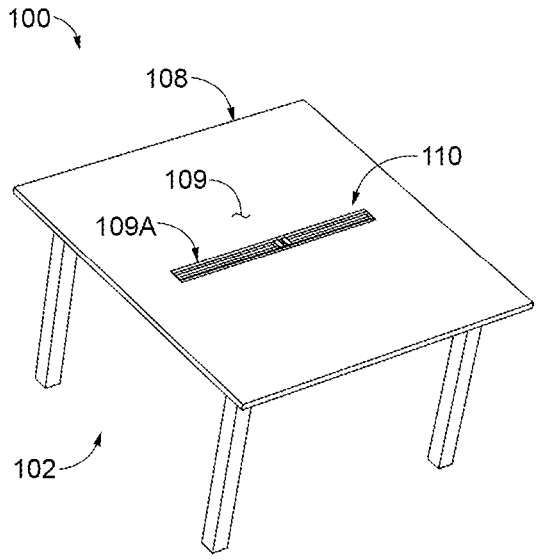
FIG. 1 is a top, front, and right side perspective view of a piece of furniture table in accordance with an embodiment.
Figure 2:
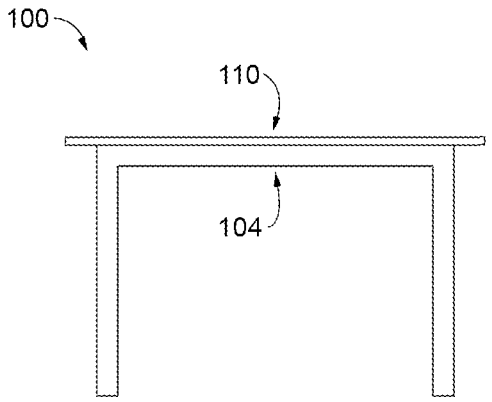
FIG. 2 is a front elevational view of the furniture of FIG. 1.
Figure 3:
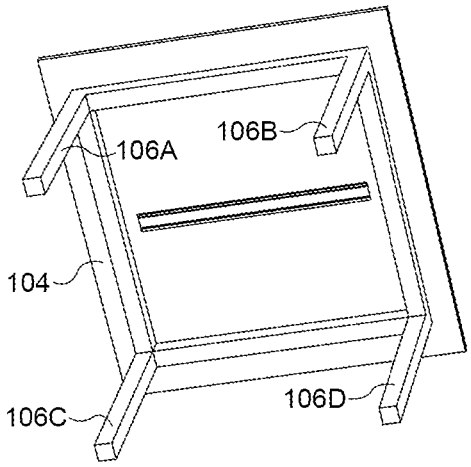
FIG. 3 is a front, bottom, and left side perspective view of the furniture of FIG. 1.

FIG. 1 illustrates a furniture assembly 100 having an improved mounting assembly 110. The mounting assembly 110 can be used to connect or mount an article 112 (FIGS. 4, 25, 26), which can be in the form of any type of article, device, or accessory. For example, but without limitation, the article 112 can be a monitor arm for supporting a monitor in a position above the top of the furniture assembly 100, a privacy barrier, a tablet or smart phone holder, pencil case, a lamp, a stapler, a hole puncher, a cup holder, a docking station, a data port hub, a charging port hub, or any other device.

In the illustrated embodiment, the furniture assembly 100 is in the form of a table which can also be considered as a desk. As such, the furniture assembly 100 includes a leg assembly 102 which includes a leg support frame 104 for supporting legs 106A, 106B, 106C and, 106D. The configuration of the leg assembly 102 is merely an example typed for illustrative purposes only. Any type of leg assembly can be used. Further, the furniture assembly 100 can be any other type of furniture. In some embodiments, the furniture assembly 100 can be in the form of, but not limited to, a nightstand, coffee table, bookshelf, conference table, side table, buffet table, medial console, etc. which may or may not have legs.

The furniture assembly 100 includes a tabletop 108, which in some embodiments can be a desktop, to which the mounting assembly 110 is attached. However, the furniture assembly 100 can include other non-flat and/or other non-horizontal surfaces to which the mounting assembly 110 can be attached.

In the illustrated embodiment, the tabletop 108 includes an upper working surface 109 with an aperture 109A. Aperture 109A can open into a recess formed in the tabletop 108 or it can be a through hole extending fully through the thickness of the tabletop 108. In some embodiments, portions of the mounting assembly 110 can be integrated with the tabletop 108 for example, formed as a monolithic part or the mounting assembly 110 can be in the form of separate members attached to the tabletop 108. In the illustrated embodiment, the aperture 109A is through hole extending through the tabletop 108 and the mounting assembly 110 is supported by support flanges 114 extending into a portion of the aperture 109A. Other configurations can also be used.

Figure 4:
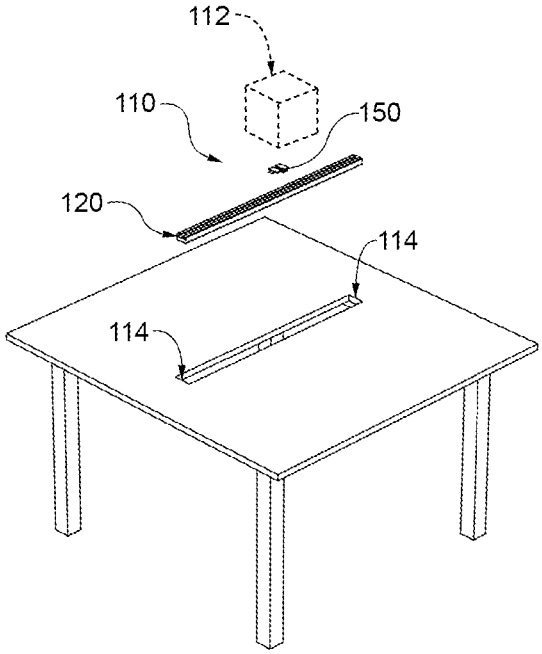
FIG. 4 is a top, right side, and front, exploded perspective view of the table of FIG. 1.

With reference to FIG. 4, the mounting assembly 110 includes a receiver member which can be in the form of a channel member 120 and one or more anchor members 150.

Figure 5:
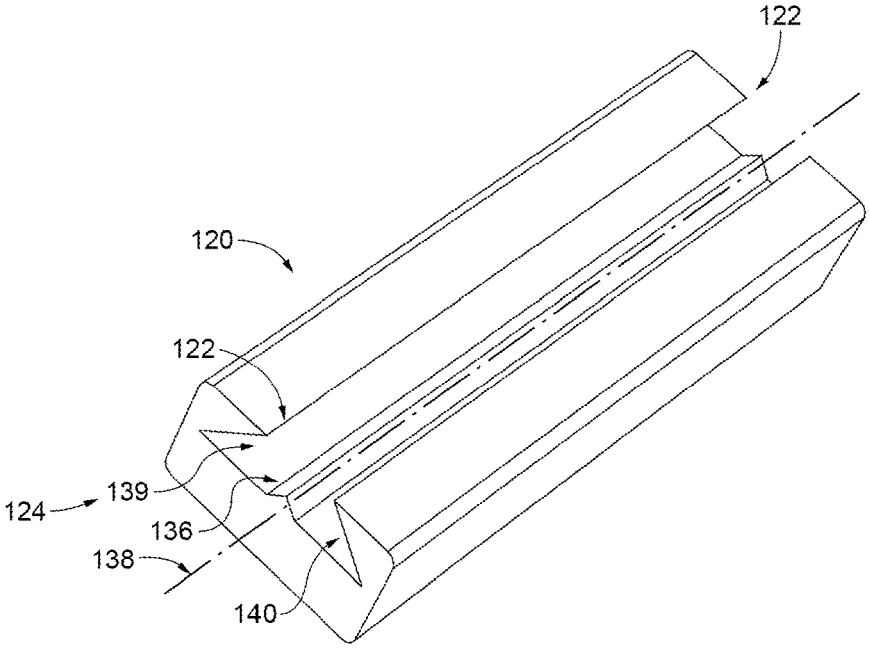
FIG. 5 is a perspective view of an optional channel member that can be used with the mounting assembly included in the table of FIG. 1.
Figure 6:
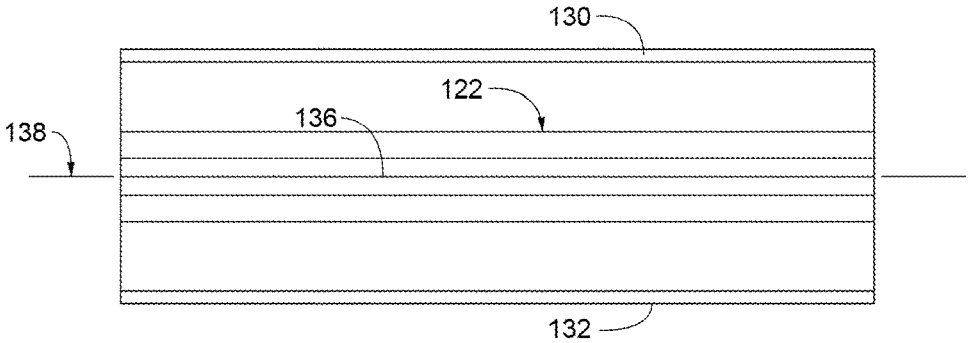
FIG. 6 is a top plan view of the channel member of FIG. 5.
Figure 7:
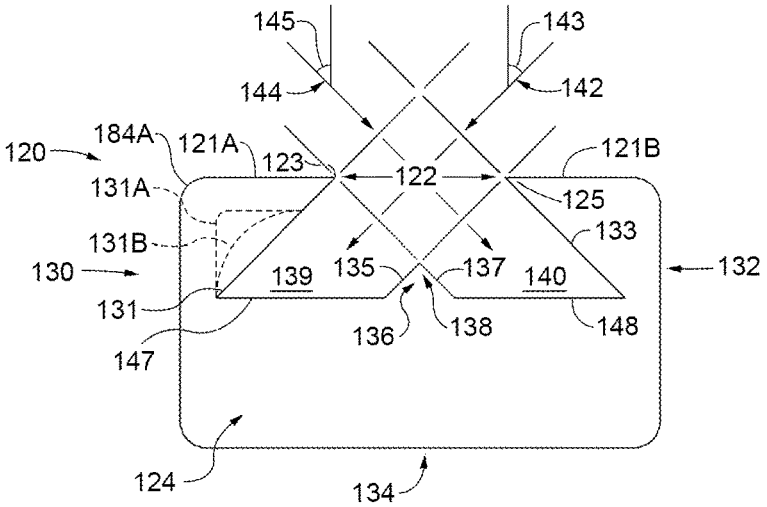
FIG. 7 is an end view of the channel member of FIG. 5 showing a cross sectional shape of the channel member.

With reference to FIGS. 5-7, the channel member 120 can be configured to define a channel. In some embodiments, the channel member 120 includes an upper aperture 122 and an enlarged inner portion 124. Other configurations can also be used.

As shown in FIG. 7, the channel member 120 can include a first sidewall 130, a second sidewall 132 and a bottom wall 134. Optionally, a ridge 136 can be positioned along the bottom wall 134.

As shown in FIG. 5, the channel member 120 can extend along the longitudinal axis 138. In some embodiments, the ridge 136 can extend along the longitudinal axis 138.

With continued reference to FIG. 7, the aperture 122 defines an opening into the channel member 120. In some embodiments, it is narrower than the lower portion 124. The lower portion 124 can be considered as including a first side portion 139 defined between the ridge 136 and the first sidewall 130 and a second side portion 140 defined between the second sidewall 132 and the ridge 136.

In some embodiments, the sidewalls 130, 132, the ridge 136, and the aperture 122 can serve as to define one or more insertion passages. For example, the aperture 122, the sidewall 130, and the ridge 136 can be considered as forming an insertion passage 142 extending through the aperture 122 and into the first side portion 139 between the sidewall 130 and the ridge 136. For example, in some embodiments, the boundaries of the insertion passage can be considered as including first and second edges 123, 125 of the aperture 122, an inner sidewall surface 131 of the first sidewall 130 and a first side surface 135 of the ridge 136. As shown in FIG. 7, the insertion passage 142 extends at an oblique angle relative to vertical, illustrated as angle 143 in FIG. 7.

Optionally, the channel member 120 can define a second insertion passage 144 extending through the aperture 122 into the second side portion 140. For example, the second insertion passage 144 can be considered as being defined by the aperture 122, the ridge 136, and the sidewall 132. In some embodiments, the insertion passage 144 is defined by the edges 123, 125 of the aperture 122, an inner facing surface 133 of the sidewall 132 and a side surface 137 of the ridge 136. Similarly to the insertion passage 142, the insertion passage 144 extends at an oblique angle relative to vertical, identified as angle 145 in FIG. 7.

In use, a combination of a plurality of the aperture 122, aperture edges 123, 125, sidewall 130, sidewall surface 131, sidewall 132, sidewall surface 133, ridge 136, ridge surface 135, ridge surface 137 and/or other portions of the channel member 120 can be considered as serving as constraints on the movement of anchor members into and out of channel member 120. Additionally, the bottom wall 134 can be considered as including inner bottom surface portion 147 which serves as a bottom surface of the first side portion 139 and bottom surface 148 which can serve as a bottom surface of the second side portion 140. Additionally, the bottom surfaces 147, 148 can also serve as constraints against movement of other members within the channel member 120, such as the anchor members 150 described below with reference to FIGS. 8-24.

In some embodiments, the insertion passage 142 can include an inner sidewall surface 135 having different configurations. For example, as shown in FIG. 7 the inner surface 131 of the sidewall 130 can have a multifaceted flat sided configuration illustrated as surface 131A or a rounded configuration such as surface 131B. Such optional configurations as well as other configurations, can be considered as forming a portion of the insertion passage 142.

With reference to FIGS. 8-15, an anchor member 150 can be configured to engage the channel member 120 in a way such that movement of the anchor member 150 into and out of the channel member 120 is constrained. For example, the anchor member 150 can have a shape that cooperates with the configuration and shape of one or both of the insertion passages 142, 144. In some embodiments, the anchor member 150 and the channel member 120 are configured such that the anchor member 150 can only freely move into and out of the channel member 120 along one or both of the insertion passages 142, 144, due to the interaction of the surfaces of the channel member 120 described above and corresponding portions or surfaces of the anchor member 150. Other configurations can also be used.

With continued reference to FIGS. 8-15, the anchor member 150 can include a top portion 152, an anchor leg 154 and optionally, an anchor connector portion 156.

Figure 8:
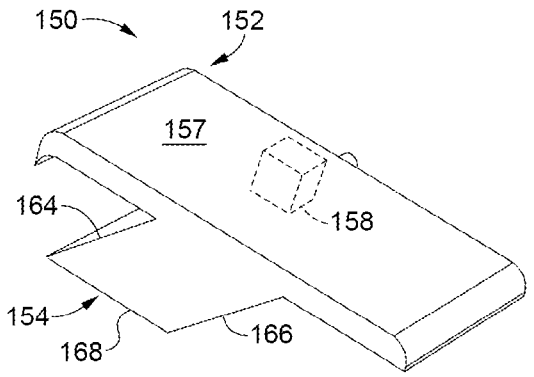
FIG. 8 is a top, right side, and front perspective view of an anchor member that can be used with the mounting assembly of the table of FIGS. 1-4 and/or the channel member of FIG. 5-7.
Figure 9:
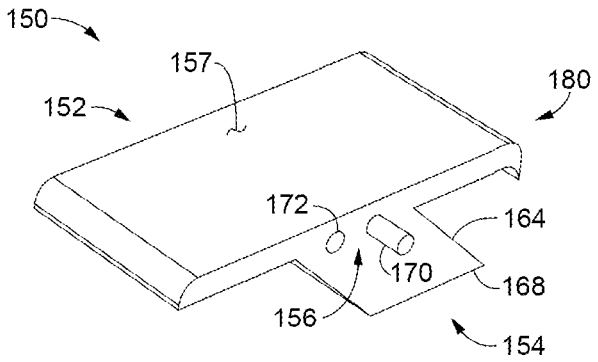
FIG. 9 is a top, front, and left side perspective view of the anchor member of FIG. 8.
Figure 10:
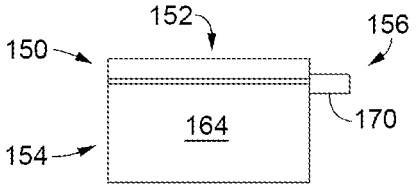
FIG. 10 is a front elevational view of the anchor member of FIG. 8.
Figure 11:
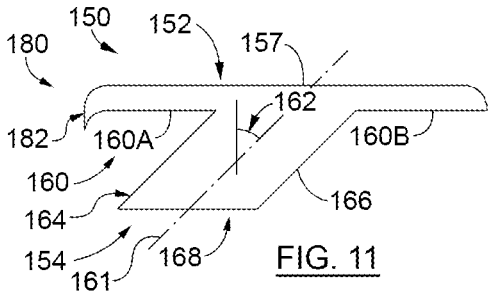
FIG. 11 is a right side elevational view of the anchor member of FIG. 8.
Figure 12:
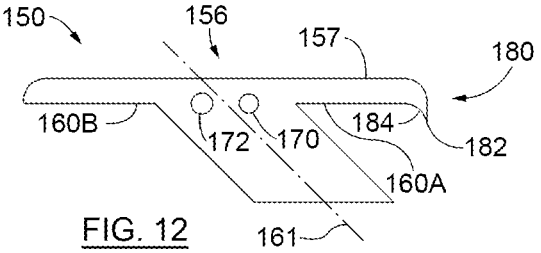
FIG. 12 is a left side elevational view of the anchor member of FIG. 8.
Figure 13:
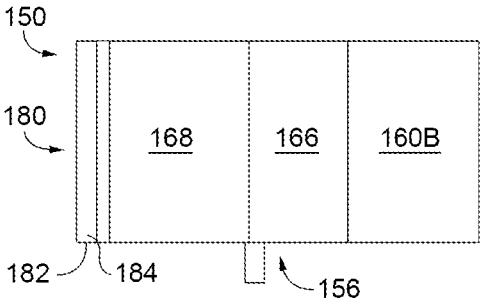
FIG. 13 is a bottom plan view of the anchor member of FIG. 8.
Figure 14:
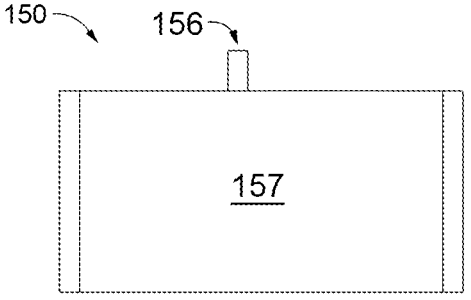
FIG. 14 is a top plan view of the anchor member of FIG. 8.

The top portion 152 can include an upper surface 157. Optionally, in some embodiments, the upper surface 157 is configured for supporting or being connected to an article such as the article 112 (FIG. 4). Thus, in some embodiments, the upper surface 157 can include an attachment mechanism 158, such as an aperture, a threaded aperture, slot, mounting boss, or any other type of mounting device, feature, or mechanism for connection for engagement, contact, or connection with an article such as the article 112. The present disclosure is not limited to any particular type of attachment mechanism and thus an optional attachment mechanism 158 as illustrated in FIG. 8. In some embodiments, attachment mechanism 158 can be formed of multiple portions, for example, the anchor member 150 can include a first part of an attachment mechanism 158 and a second part of the attachment mechanism 158 can be provided on another, adjacent anchor member, for example, where two anchor members are used together as described below with reference to FIGS. 21-24.

In some embodiments, the top portion 152 of the anchor member 150 includes a lower facing surface 160 which can include a first surface portion 160A and a second surface portion 160B. In some embodiments, the first and second surface portions 160A, 160B are sized and oriented to be juxtaposed to and/or make contact with upper surface portions 121A, 121B, respectively (FIG. 7) of the channel member 120.

In some embodiments, the overall width of the top portion 152 of the anchor member 150 has approximately the same overall width as the channel member 120.

With continued reference to FIGS. 8-15, the anchor leg 154 can extend downwardly from the top portion 152, for example, downwardly from the lower surface 160 of the top portion 152. In some embodiments, the anchor leg 154 extends downwardly from the top portion 152 along an anchor leg angle 162 which can be approximately the same as the insertion passage angle 143 (FIG. 7). In some embodiments, the anchor leg 154 can be considered as including first side surface 164, a second side surface 166 and a bottom surface 168. The surfaces 164, 166 can, in some embodiments, be oriented at approximately the same angle as angle 162. Further, optionally, the side surfaces 164, 166 can be parallel to one another.

The anchor leg 154 can be considered as extending along anchor leg direction 161 at the anchor leg angle 162. In some embodiments, the anchor leg 154 can be configured such that the anchor leg 154 is insertable into the first side portion 139 of the channel member 120 through the aperture 122 into the first insertion passage, for example, with the anchor leg direction 161 oriented coincident or parallel with the insertion passage 142. In some embodiments, the anchor leg 154 is configured, for example, sized, such that once the anchor member 150 is inserted into the insertion passage 142, movement of the anchor member 150 is constrained such that it can only move in or out of the channel member 120 by being translated in a direction along the insertion passage 142, which is oriented at an angle 143 relative to perpendicular.

With continued reference to FIGS. 8-14, the connection portion 156 can be configured to engage with an adjacent body or surface for providing an additional constraint on the movement of the anchor 150. For example, the connection portion 156 can be configured to engage with a portion of the tabletop 108, a portion of the channel member 120, another body or surface not illustrated, or another anchor member having the same or similar configuration of the anchor member 150.

The connection portion 156 can have any type of configuration. In some embodiments, as noted above, the connection portion 156 includes portions that can provide an additional constraint on the movement of the anchor 150.

Thus, for example, the connection portion 156 can be configured to engage with another body, surface, or member in a way so as to interfere with movement of the anchor member 150 along the anchor leg direction 161. Thus, many different types of connection devices or mechanisms could be used as the connection portion 156.

In the illustrated embodiment, the connection portion 156 includes at least one of a projection 170 and a recess 172. In the illustrated embodiment, the connection portion 156 includes both a projection 170 and a recess 172. The projection 170 can have any shape, for example but without limitation, square, rectangular, triangular, polygonal, dome, rounded, etc. In the illustrated embodiment, the projection 170 is cylindrical. Other configurations can also be used.

The recess 172 can also have any shape, including but without limitation, square, rectangular, triangular, polygonal, dome, rounded, etc. In the illustrated embodiment, the recess 172 is cylindrical. In some embodiments, the projection 170 and the recess 172 can be sized to have approximately the same dimensions, for example, the projection 170 can have an outer surface the diameter that is slightly smaller than an inner diameter of the recess 172. As such, the projection 170 can be considered as being configured to fit within the recess 172.

The projection 170 can be configured to engage with another body that would constrain its movement along the direction 161. Similarly, the recess 172 can be configured to engage with another surface or body that would provide a constraint against movement of the anchor member 150 in the direction of the anchor leg 161.

In some embodiments, the anchor member 150 can be connected to another anchor member (described below with reference to FIGS. 21-24) wherein the additional anchor member has a connection portion that is configured to engage with the connection portion 156.

With continued reference to FIGS. 9 and 11-15, the anchor member 150 can optionally include a retainer portion 180 configured to provide a retaining engagement with the channel member 120. The retainer portion 180 can have any configuration. In some embodiments, the retainer portion 180 is configured to provide a snap fit with the channel member 120. Any type of configuration can be used for providing a snap fit.

In the illustrated embodiment, the retainer portion 180 includes a projection 182 that extends downward from the surface 160A. In some embodiments, the projection 182 can extend downwardly from the surface 160A along the direction that is transverse to the anchor leg direction 161. Additionally, optionally, in some embodiments, the projection 182 can include an inner curved portion 184 that has a shape that is complimentary to a curved outer shoulder portion 184A of the channel member 120 (FIG. 7 and FIG. 16-20), further described below with reference to FIG. 16-20.

In some embodiments, the projection 182 is configured to be resilient. For example, the projection 182 can be configured to deflectable, in use, to provide interference during a portion of the movement of the anchor member 150 into the channel member 120, deflect elastically, then snap into position for retaining the anchor member 150 to the channel member 120. In some configurations, the retainer portion 180 can be configured to provide an additional constraint on the movement of the anchor member 150 in a direction out of the channel member 120.

Figure 15:
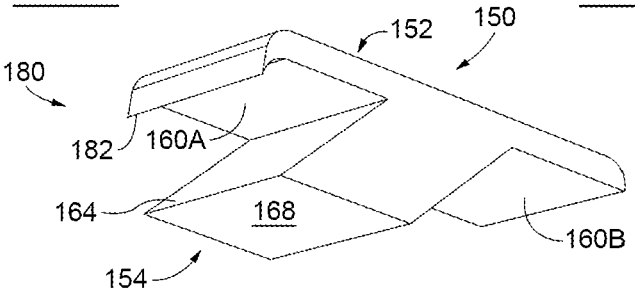
FIG. 15 is a bottom, right side, and rear perspective view of the anchor member of FIG. 8.
Figure 15A:
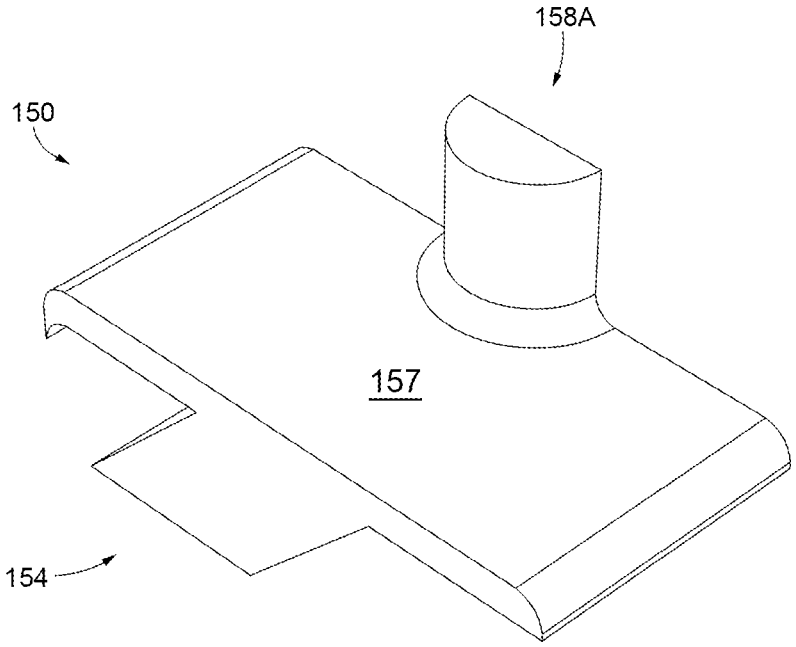
FIG. 15A is a top, front, and right side perspective view of a modification of the anchor member of FIGS. 8-15.
Figure 15B:
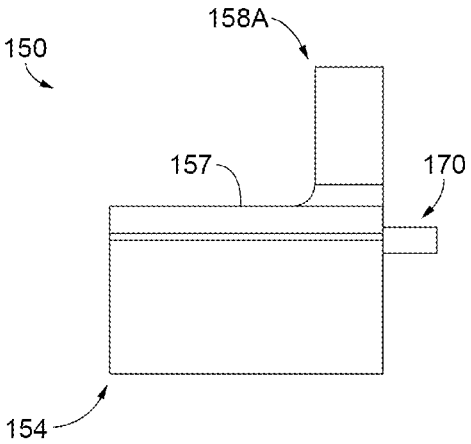
FIG. 15B is a front elevational view of the anchor member of FIG. 15A.
Figure 15C:
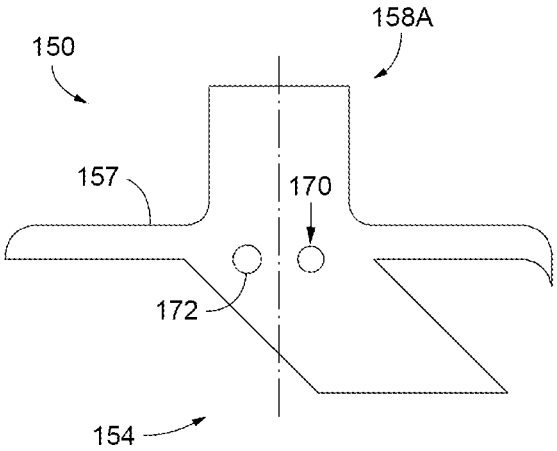
FIG. 15C is a left side elevational view of the anchor member of FIG. 15A.
Figure 16:
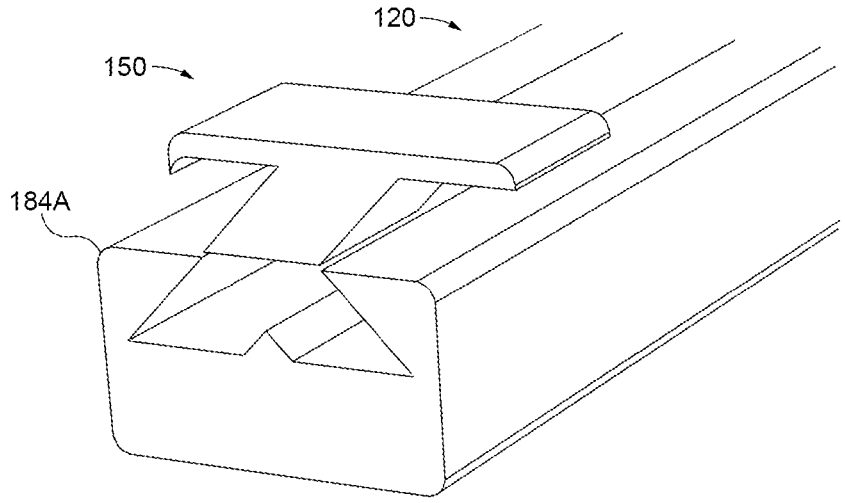
FIG. 16 is a top, front, and right side perspective view of the channel member of FIG. 5 and the anchor member of FIG. 8, in an exploded orientation.

FIGS. 15A-15C illustrate a variation of the attachment mechanism 158, identified generally by the reference numeral 158A. As shown in FIGS. 15A-15C, the attachment mechanism 158A can be in the form of a portion of an attachment mechanism which can cooperate with another portion of an attachment mechanism to form a multi-part attachment mechanism. For example, the attachment mechanism 158A extends upwardly from the upper surface 157 and has a generally half-cylinder shape. In some embodiments, the attachment mechanism 158A, having a partial, half-cylinder shape, or other shape, can be used alone or in combination with another member for connection to accessory (e.g., accessory 112 FIG. 4), described in greater detail below with reference to FIGS. 24A, 25, and 26.

Figure 17:
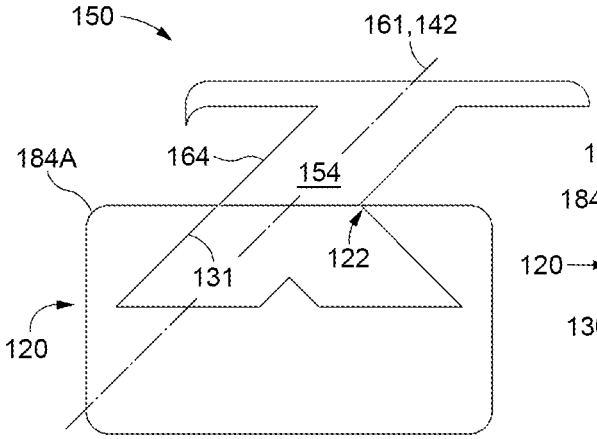
FIG. 17 is a right side elevational view of the anchor member and channel member of FIG. 16.

With reference to FIGS. 16-20, as noted above, the anchor member 150 can be configured to be inserted into the channel member 120. In some embodiments, the anchor member 150 and the channel member 120 are configured such that the anchor member 150 can only be fully seated into the channel member 120 when inserted along a direction in which the anchor member 150 is moved along the anchor leg direction 161 and the insertion passage 142, which are aligned so as to be either coincident or parallel. For example, with reference to FIGS. 16 and 17, the anchor member 150 can be aligned with the anchor leg 154 aligned with the aperture 122 and with the anchor leg direction 161 coincident with or parallel to the insertion passage 142. In the illustrated embodiment, some misalignment of the anchor leg 154 and the insertion passage 142 can be accommodated, for example, during movement of the anchor member 150 as illustrated in FIG. 17 and the position illustrated in FIG. 18.

Figure 18:
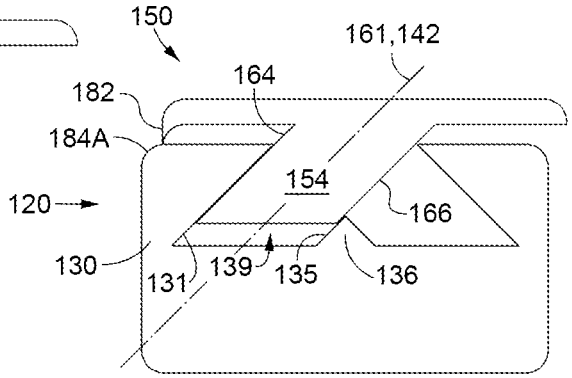
FIG. 18 is a right side elevational view of the anchor member partially inserted into the channel member of FIG. 16.

With continued reference to FIG. 18, once the lower end of the anchor leg 154 reaches the first side portion 139 disposed between the surface 135 of the ridge 136 and the inner surface 131 of the sidewall 130, the alignment of the anchor member 150 is constrained. In other words, as the lower portion of the anchor leg 154 reaches the space defined at the first side portion 139, the outer surfaces 166, 164 of the anchor leg 154 are constrained by the surfaces 135, 131 of the channel member 120 such that the anchor leg 154 can only move into or out of the first side portion 139 when the anchor member 150 is moved in the direction of the insertion passage 142.

Figure 19:
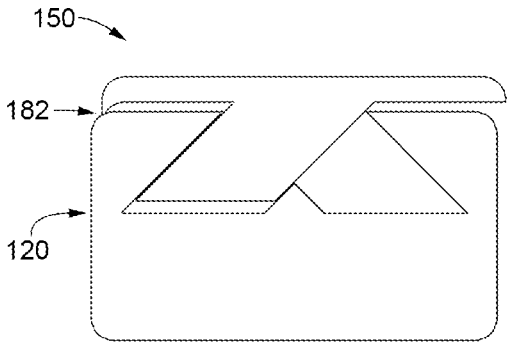
FIG. 19 is a right side elevational view of the anchor member inserted into the channel member of FIG. 16, in an intermediate orientation and prior to an optional snap fit engagement.
Figure 20:
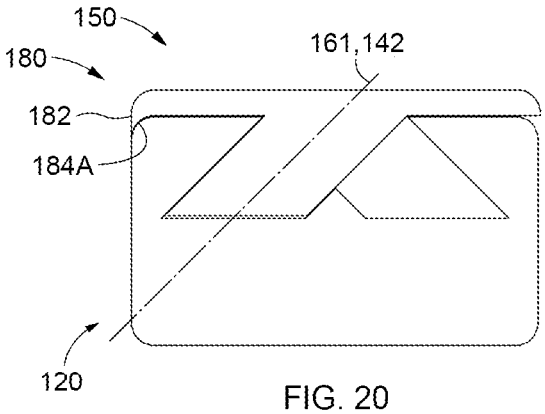
FIG. 20 is a right side elevational view of the anchor member fully seated channel member of FIG. 16, with an optional snap fit engagement.
Figure 21:
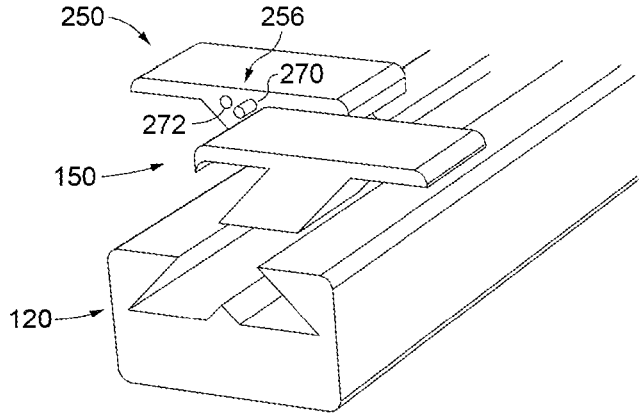
FIG. 21 is a top, front, and right side perspective view of the anchor and channel members of FIG. 16, with a second anchored member shown in an exploded orientation.

With continued reference to FIGS. 18-20, in embodiments in which the anchor member 150 includes the retainer portion 180, the projection 182 can make initial contact with an upper portion of the channel member 120, such as the curved outer shoulder portion 184A. Further pressing of the anchor member 150 along the insertion passage 142 can cause the projection 182 to elastically deflect, as illustrated in FIG. 19, thereby providing some interference between the projection 182 and the rounded shoulder 184. Further movement of the anchor member 150 along the insertion passage 142 allows the projection 182 to elastically return to its original shape or close to its original shape, in the orientation illustrated in FIG. 20.

In the position illustrated in FIG. 20, the projection 182 provides an additional constraint against the movement of the anchor member 150 relative to the channel member 120. As such, the retainer 180 can provide a snap fit-type engagement to retain the anchor member 150 in the position illustrated in FIG. 20, in which is it inserted into the channel member 120. The size, shape, and configuration of the retainer 180 can be chosen to provide snap fit engagement that is manually engageable and disengageable by a user, and in some embodiments, without any tools.

With reference to FIGS. 21-24, the connection portion 156 can be used to provide a further anchoring effect for anchoring the anchor member 150 to the channel member 120. In the illustrated embodiment, the connection portion 156 engages with the engagement portion on another anchor member. In the illustrated embodiment, the anchor member 150 is used in conjunction with a second anchor member identified generally by the reference numeral 250. Parts, components, features and functions of the additional anchor member 250 are identified with the same reference numeral as those of the anchor member 150, except that the value of "100" have been added thereto.

In some embodiments, an additional anchor member 250 has the same shape and configuration as the anchor member 150, but is used in a different orientation. For example, in the illustrated embodiment, the additional member 250 has been rotated 180 degrees about the vertical axis relative to the anchor member 150. As such, the connector portion 156 of the anchor member 150 faces toward the connection portion 256 of the anchor member 250.

In some embodiments, the projection 170 and the recess 172 are positioned symmetrically about a central vertical axis of the anchor member 150. Thus, if an identical anchor member 150 is used as the anchor member 250, the projection 170 would align with the corresponding recess 172, when the second anchor member is rotated 180 degrees about the vertical axis. The illustrated embodiment has this configuration.

Figure 22:
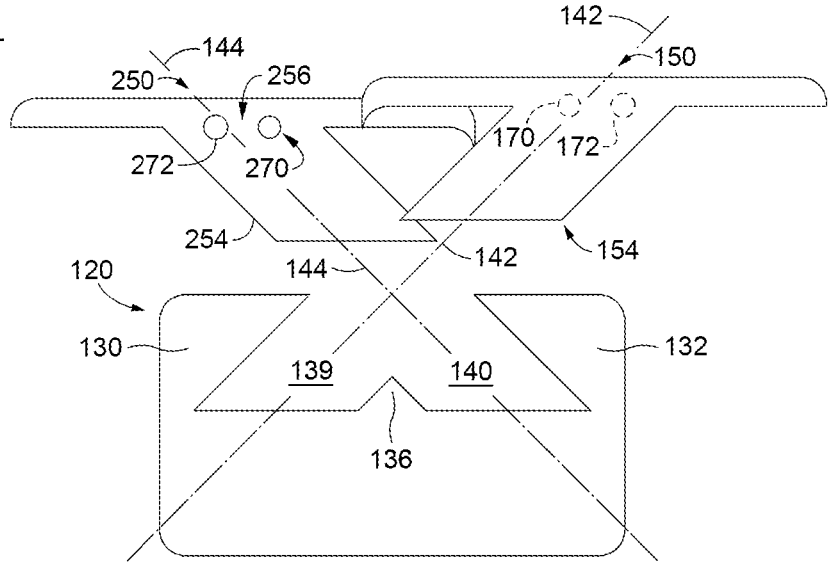
FIG. 22 is a right side elevational view of the two anchor members and the channel member of FIG. 21.

With reference to FIG. 22, the anchor member 150 can be inserted into the channel member 120 such that the anchor leg portion 154 is inserted into the first side portion 139 between the first sidewall 130 and the ridge 136. Similarly the anchor leg 254 of the anchor member 250 can be inserted into the second side portion 140 between the second sidewall 132 and the ridge 136. The inserted orientation is illustrated in FIG. 23.

Figure 23:
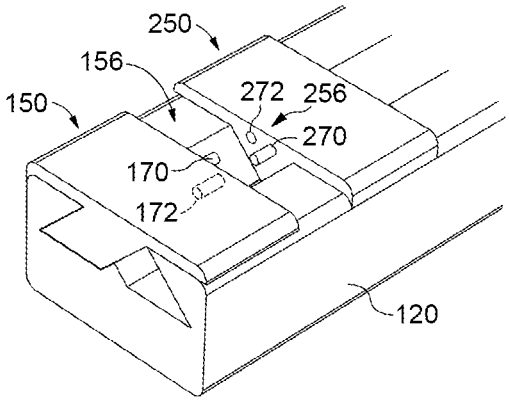
FIG. 23 is a top, right side, and front elevational perspective view of the anchor members of FIG. 21 in fully seated orientations within the channel member, and being spaced apart from one another.

As shown in FIG. 23, the anchor members 150 and 152 can be inserted into the channel member 120 in a spaced apart orientation such that the connector portions 156 and 256 do not collide with each other.

With the anchor members 150, 250 initially in the position illustrated in FIG. 23, the anchor members 150, 250 can then be slid along the longitudinal direction of the channel member 120 until the connection portions 156, 256 engage with each other. In the illustrated embodiment, the projection 170 received within the recess 272 and the projection 270 is received within the recess 172.

Figure 24:
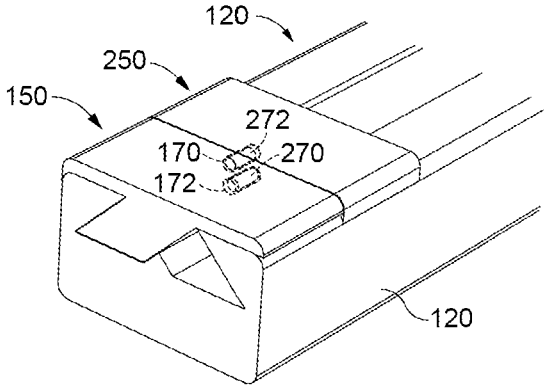
FIG. 24 is a top, right side, and front perspective view of the anchor members and channel member of FIG. 23, with the anchor members connected to each other.

With the anchor members 150, 250 engaged with each other, in the orientation illustrated in FIG. 24, the anchor members 150, 250 are effectively locked into the channel member 120. This is because, as described above with reference to FIGS. 16-20, once the anchor member 150 is in any of the orientations illustrated in FIGS. 18-20, the anchor member 150 can only be withdrawn from the channel member by movement along the direction of the insertion passage 142. Similarly, the anchor member 250 can only be withdrawn from the channel member when moved along the direction of the insertion passage 144 (FIGS. 7 and 22). Thus, when the connection portions 156 and 256 are engaged with each other, as in the orientation illustrated in FIG. 24, the anchor members 150, 250 cannot be withdrawn from the channel member 120.

Figure 24A:
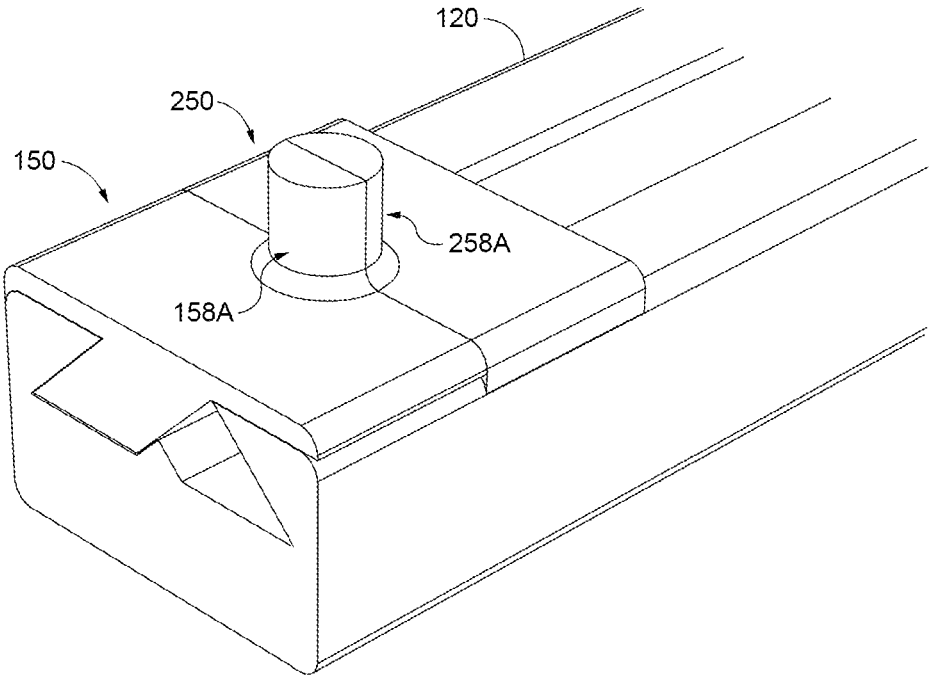
FIG. 24A is a top, front, and right side perspective view of the modified anchor members of FIG. 15A-15C, connected to a channel member.

FIG. 24A illustrated a modification in which the anchor members 150 and 250 include the attachment mechanisms 158A, 258A, respectively. With the anchor members 150, 250 orientated as such, the attachment mechanisms 158A, 258A cooperate to form a multi-part attachment mechanism, formed of the two attachment mechanisms 158A, 258A juxtaposed to each other. In some embodiments, such as those in which the attachment mechanisms 158A, 258A are formed of half-cylinders, the resulting multi-part attachment mechanism is cylindrical or generally cylindrical.

Figure 25:
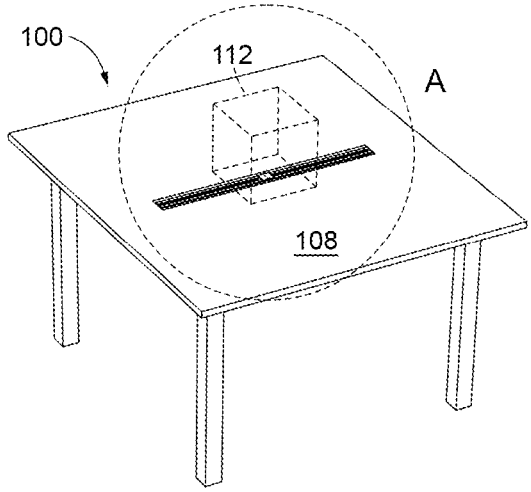
FIG. 25 is a top, right side, and front perspective view of the table of FIG. 1 with the anchor members and channel member in the configuration illustrated in FIG. 24 and with an article attached to one of the anchor members.
Figure 26:
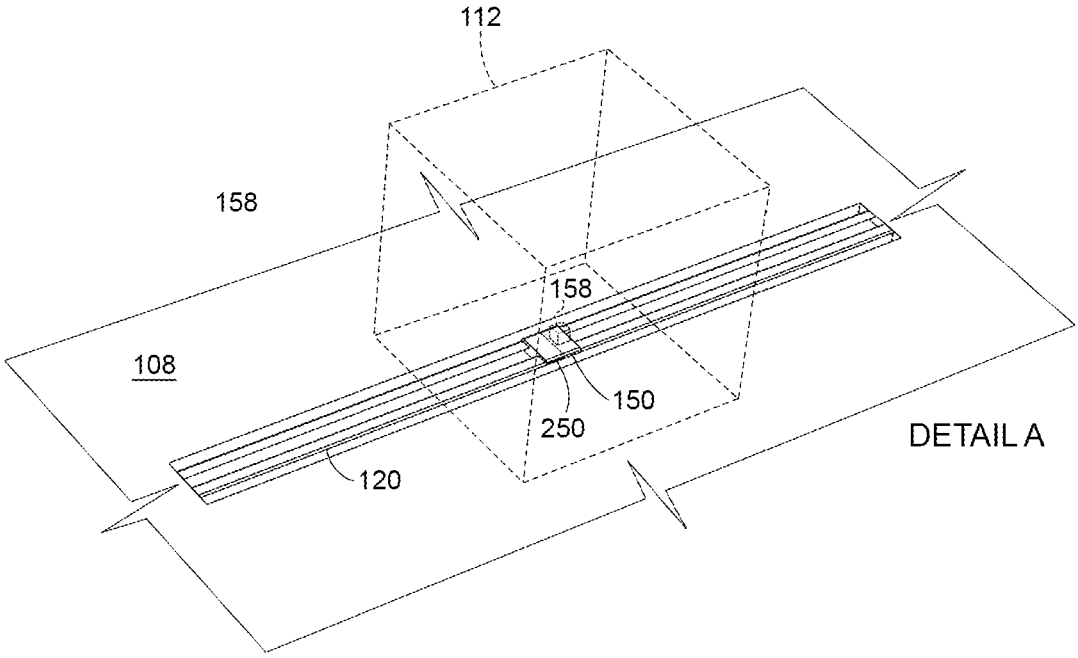
FIG. 26 is an enlarged top, right side, and front perspective view of the table and article of FIG. 25.

With reference to FIGS. 25 and 26, if the anchor members 150 and 250 locked into channel member 120 as described above, any device or accessory attached to either one of the anchor members 150, 250 are also effectively locked to the channel member 120. FIGS. 25 and 26 illustrate article 112 fixed to the anchor member 150. Then with the anchor members 150, 250 locked to the channel member 120, thereby fixing the article 158 to the channel member 120.

Additionally, in some embodiments, the accessory 112 can include an attachment portion that is configured to connect with a multi-part attachment mechanism. For example, in some embodiments, the accessory 112 can include an attachment portion (not shown) configured to connect with both of the attachment mechanisms 158A, 258A, when the anchor members 150, 250 oriented in the orientation illustrated in FIG. 24A. For example, but without limitation, the attachment portion of the accessory can include a cylindrical bore, sized to receive or releasably connect to the combined half-cylindrical portions of the attachment mechanisms 158A, 258A. Optionally, the accessory can thereby provide a constraint on the movement of the anchor members 150, 250. For example, with the attachment mechanisms 158A, 258A received in such a bore, the attachment mechanisms 158A, 258A would be constrained against movements having a horizontal component and thus would prevent the anchor members 150, 250 from being removed from the channel member 120.

While several embodiments are presented in the foregoing detailed description, a vast number of variations exist. The embodiments described herein are not intended to limit the scope, applicability, or configuration of the claimed subject matter in any way. Rather, the foregoing detailed description provides those skilled in the art with a convenient road map for implementing the described embodiments. Various changes can be made in the function and arrangement of elements without departing from the scope defined by the claims, which includes known equivalents and foreseeable equivalents at the time of filing this patent application.

What is claimed is:

1. A desk having an accessory mount for mounting accessories to the desk, the desk comprising:

a first leg assembly;

a desktop supported by the leg assembly;

a channel member having a longitudinal axis and recessed into the desktop, the channel member having a channel comprising a first side wall, a bottom wall and a second sidewall opposite the first side wall, the channel member comprising:

an aperture between upper ends of the first and second side walls; and a ridge positioned on the bottom wall, extending along a longitudinal axis of the channel member, wherein the ridge divides the bottom wall into a first side portion between the ridge and the first sidewall and a second side portion between the ridge and the second sidewall, wherein the ridge protrudes upwardly from both the first and second side portions of the bottom wall;

wherein the first and second sidewalls, the aperture and the ridge form a first insertion passage extending through the aperture toward the first side portion along a first insertion angle and a second insertion passage through the aperture and towards the second side portion along a second insertion angle, the first and second insertion passages being non parallel to each other and non-perpendicular to the bottom wall;

a first anchor member comprising a first top wall and a first anchor leg extending downwardly from the top wall at a first anchor leg angle that is approximately equal to the first insertion angle, and a first connector portion;

wherein the first anchor leg is sized so as to be constrained by the aperture, first sidewall, second sidewall, and the ridge, in use, to movement along the first insertion angle when the first anchor leg is inserted into the first side portion of the channel member; and a second anchor member comprising a second top wall and a second anchor leg extending downwardly from the top wall at a second anchor leg angle that is approximately equal to the second insertion angle, and a second connector portion configured to connect with the first connector portion;

wherein the second anchor leg is sized so as to be constrained by the aperture, first sidewall, second sidewall, and the ridge, in use, to movement along the second insertion angle when the second anchor leg is inserted into the second side portion of the channel member;

wherein when the first connector portion is connected to the second connector portion with the first anchor leg positioned in the first side portion of the channel member and the second anchor leg positioned in the second side portion of the channel member, the connected first and second anchor members are constrained from removal from the channel member along any direction extending from within the channel member outwardly through the aperture.

2. A desk according to claim 1 additionally comprising an accessory attached to the first anchor member, the first and second anchor members securing the accessory to the channel member in a position above the desktop.

3. A table having an accessory mount, the table comprising:

a first leg assembly;

a tabletop supported by the leg assembly;

a channel having a longitudinal axis and being recessed into the tabletop, the channel comprising:

a first sidewall;

a bottom wall;

a second sidewall opposite the first wall;

an aperture between upper ends of the first and second sidewalls; and a ridge positioned on the bottom wall, extending along the longitudinal axis of the channel and divides the bottom wall into a first side portion between the ridge and the first sidewall and a second side portion between the ridge and the second sidewall, wherein the ridge protrudes upwardly from both the first and second side portions of the bottom wall;

a first anchor member comprising a first top wall, a first connector portion, and a first anchor leg extending downwardly from the top wall at a first anchor leg angle; and a second anchor member comprising a second top wall, a second connector portion configured to connect with the first connector portion, and a second anchor leg extending downwardly from the top wall at a second anchor leg angle;

wherein when the first connector portion is connected to the second connector portion with the first anchor leg positioned in the first side portion of the channel and the second anchor leg positioned in the second side portion of the channel, the connected first and second anchor members are constrained from removal from the tabletop along any direction extending from within the channel outwardly through the aperture.

4. The table according to claim 3 additionally comprising an accessory attached to the first anchor member, the first and second anchor members securing the accessory to the channel member in a position above the tabletop.

5. The table according to claim 3, wherein the ridge protrudes upwardly from the bottom wall, dividing the bottom wall into the first side portion between the ridge and the first sidewall and the second side portion between the ridge and the second sidewall.

6. The table according to claim 5, wherein the first and second sidewalls, the aperture and the ridge form a first insertion passage extending through the aperture toward the first side portion along a first insertion angle and a second insertion passage through the aperture and towards the second side portion along a second insertion angle, the first and second insertion passages being non parallel to each other and non-perpendicular to the bottom wall.

7. The table according to claim 6, wherein the first anchor leg angle is approximately equal to the first insertion angle and the second anchor leg angle that is approximately equal to the second insertion angle.

8. The table according to claim 6, wherein the first anchor leg is sized so as to be constrained by the aperture, first sidewall, second sidewall, and the ridge, in use, to movement along the first insertion angle when the first anchor leg is inserted into the first side portion of the channel and wherein the second anchor leg is sized so as to be constrained by the aperture, first sidewall, second sidewall, and the ridge, in use, to movement along the second insertion angle when the second anchor leg is inserted into the second side portion of the channel.

9. A mounting assembly comprising:

a channel member defining a channel and comprising a first side wall, a bottom wall, a second sidewall opposite the first wall, an aperture between upper ends of the first and second sidewalls, and a ridge positioned on the bottom wall and extending along a longitudinal axis of the channel member, wherein the ridge protrudes upwardly from both of first and second side portions of the bottom wall;

a first anchor member comprising a first top wall, a first connector portion, and a first anchor leg extending downwardly from the top wall at a first anchor leg angle; and a second anchor member comprising a second top wall, a second connector portion configured to connect with the first connector portion, and a second anchor leg extending downwardly from the top wall at a second anchor leg angle;

wherein the first and second anchor members are configured to be captured within the channel member when the first connector portion is connected to the second connector portion and the first anchor leg and the second anchor leg are positioned within the channel.

10. The mounting assembly according to claim 9 additionally comprising an accessory attached to the first anchor member, the first and second anchor members securing the accessory to the channel member.

11. The mounting assembly according to claim 9, wherein the ridge protrudes upwardly from the bottom wall, dividing the bottom wall into the first side portion between the ridge and the first sidewall and the second side portion between the ridge and the second sidewall.

12. The mounting assembly according to claim 9, wherein the first and second sidewalls, the aperture and the ridge form a first insertion passage extending through the aperture toward the first side portion along a first insertion angle and a second insertion passage through the aperture and towards the second side portion along a second insertion angle, the first and second insertion passages being non parallel to each other and non-perpendicular to the bottom wall.

13. The mounting assembly according to claim 12, wherein the first anchor leg angle is approximately equal to the first insertion angle and the second anchor leg angle that is approximately equal to the second insertion angle.

14. The mounting assembly according to claim 9, wherein the first anchor leg is sized so as to be constrained by the aperture, first sidewall, second sidewall, and the ridge to movement along a first insertion angle when the first anchor leg is inserted into the first side portion of the channel member and wherein the second anchor leg is sized so as to be constrained by the aperture, first sidewall, second sidewall, and the ridge to movement along a second insertion angle when the second anchor leg is inserted into the second side portion of the channel member.

15. The mounting assembly according to claim 9, in combination with a desk having a desktop, the channel member being recessed into the desktop.

16. The mounting assembly according to claim 9, wherein when the first connector portion is connected to the second connector portion with the first anchor leg positioned in the first side portion of the channel member and the second anchor leg positioned in the second side portion of the channel member, the connected first and second anchor members are constrained from removal from the channel member along any direction extending from within the channel member outwardly through the aperture.

17. The mounting assembly according to claim 9, wherein the first anchor member comprises a first attachment portion and the second anchor member comprises a second attachment portion, the first and second attachment portions being configured to mate for connecting to an accessory.

* * * * *